United States Patent [19]

Brophy et al.

[11] Patent Number: 4,730,566

[45] Date of Patent: Mar. 15, 1988

[54] AUTOMATIC POCKET LABEL STITCHER

[75] Inventors: Thomas G. Brophy, Gloucester; Michael R. Porter, Topsfield, both of Mass.

[73] Assignee: Porter Sewing Machines, Inc., Beverly, Mass.

[21] Appl. No.: 652,174

[22] Filed: Sep. 18, 1984

[51] Int. Cl.[4] ..... D05B 21/00; D05B 3/22; D05B 27/08; D05B 27/14

[52] U.S. Cl. ..... 112/121.12; 112/113; 112/114; 112/309; 112/318

[58] Field of Search ..... 112/121.12, 121.11, 112/121.15, 2, 63, 113, 104, 114, 308, 309, 121.26, 318

[56] References Cited

U.S. PATENT DOCUMENTS

| | | | |
|---|---|---|---|
| 3,799,085 | 3/1974 | Webber | 112/121.12 |
| 4,265,187 | 5/1981 | Torre | 112/121.26 |
| 4,467,733 | 8/1984 | Martin | 112/2 |
| 4,506,611 | 3/1985 | Parker et al. | 112/63 X |
| 4,530,294 | 7/1985 | Pollmeier et al. | 112/63 |
| 4,665,848 | 5/1987 | Michaels et al. | 112/121.26 |

*Primary Examiner*—H. Hampton Hunter

*Attorney, Agent, or Firm*—Wolf, Greenfield & Sacks

[57] ABSTRACT

In a sewing machine, a clamp-type work feeder includes an articulated, rotatable, telescoping tube carriage which can move in either direction parallel to the lower arm and rotate about the axis of the cylindrical end of the lower arm in accordance with a stored stitch program. A cylinder actuated clamp mechanism pivotally attached to the carriage allows simple work insertion and full peripheral stitching without unduly obstructing the operator's view or access to the stitching area.

14 Claims, 33 Drawing Figures

FIG. 20
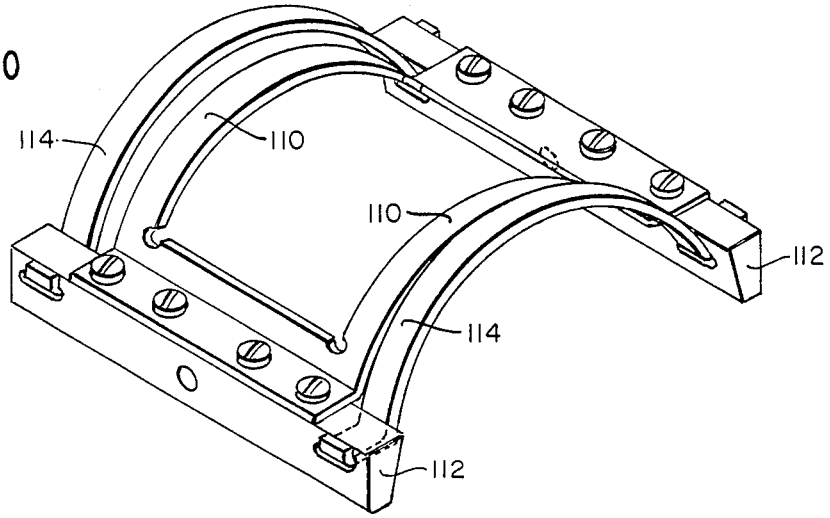
FIG. 16B
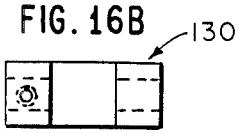
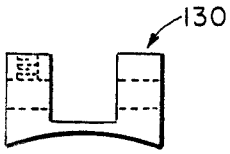
FIG. 16A
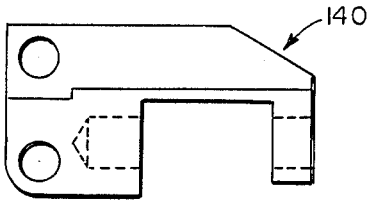
FIG. 17A
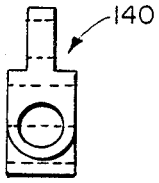
FIG. 17B
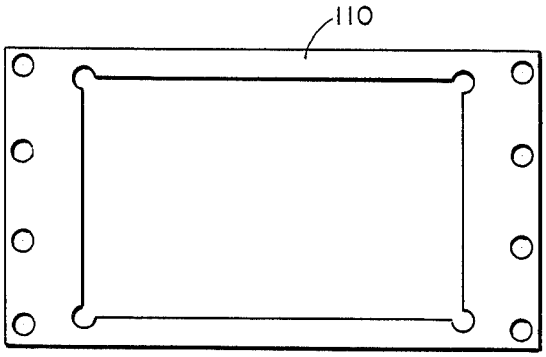
FIG. 18A
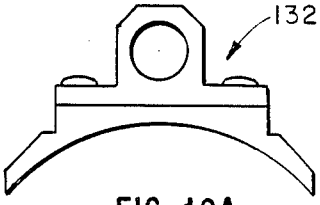
FIG. 19A
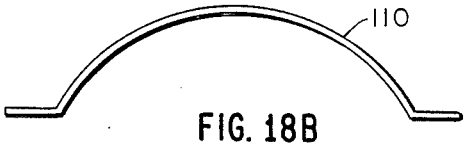
FIG. 18B
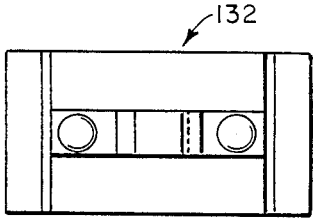
FIG. 19B

AUTOMATIC POCKET LABEL STITCHER

BACKGROUND OF THE INVENTION

The present invention relates to a new work piece handling apparatus for sewing machines and in particular to automatic apparatus for sewing labels, patches or emblems on pockets, sleeves, pant legs, small bags, sacks, pouches or other work pieces of generally tubular construction.

On suit coats, sport jackets, and outerwear, the maker's label can usually be found on the inside pocket. It is customary to affix the label only after the garment is completed. In the past, the labels were typically hand sewn through the layer of material which forms the pocket. The excess labor cost for sewing on labels in this manner was, of course, disproportionately high.

Accordingly, the primary object of the present invention is to automate the pocket label sewing operation for a finished garment.

SUMMARY OF THE INVENTION

Generally, the present invention represents improvements in automatic work feeding apparatus for a programmable sewing machine. A clamp-type work feeder includes an articulated, rotatable, telescoping tube carriage which is mechanized to move parallel to the lower arm and to rotate about the axis of the lower arm in accordance with a stored stitch program. A cylinder-actuated clamp mechanism facilitates insertion of the work and allows full peripheral stitching around a label or patch while holding it in place and rotating and translating it without unduly obstructing the operator's view or access to the stitching area and without increasing the dimensions of the end of the lower arm.

In the preferred embodiment of the invention, an existing programmable sewing machine with a two axis ball carriage driven sewing table is converted to rotate about the axis of the end of the lower arm in accordance with the normal command to move in a direction perpendicular to the drive shaft. For this purpose, a plurality of articulated coaxial tubes or sleeves are mounted about the lower needle (or "hook") drive shaft. The front sleeve carries a two-part pivoting clamp mechanism actuated by a plurality of cylinders mounted to the outer rear tube body. The clamp assembly includes a label locator frame and a shoe which engages the middle of the label inside the frame. The shoe is connected via a U-shaped yoke which flips from one orientation to the other to allow the upper needle to complete the full 360° periphery of the label.

Other objects, features, and advantages of the invention will appear from the description of the preferred embodiment thereof, taken together with the accompanying drawings in which:

BRIEF DESCRIPTION OF THE DRAWING

FIGS. 16A and 16B are respectively side and top views of the dual clamp pivot block shown in phantom in FIG. 13;

FIGS. 17A and 17B are respectively side and front views of the swivel block of FIG. 13;

FIGS. 18A and 18B are top and front views of the label clamp of FIGS. 13 and 14; and FIGS. 19A and 19B are respectively side and top views of the clamp shoe of FIG. 13.

DETAILED DESCRIPTION OF A PARTICULAR PREFERRED EMBODIMENT

Figure 1:
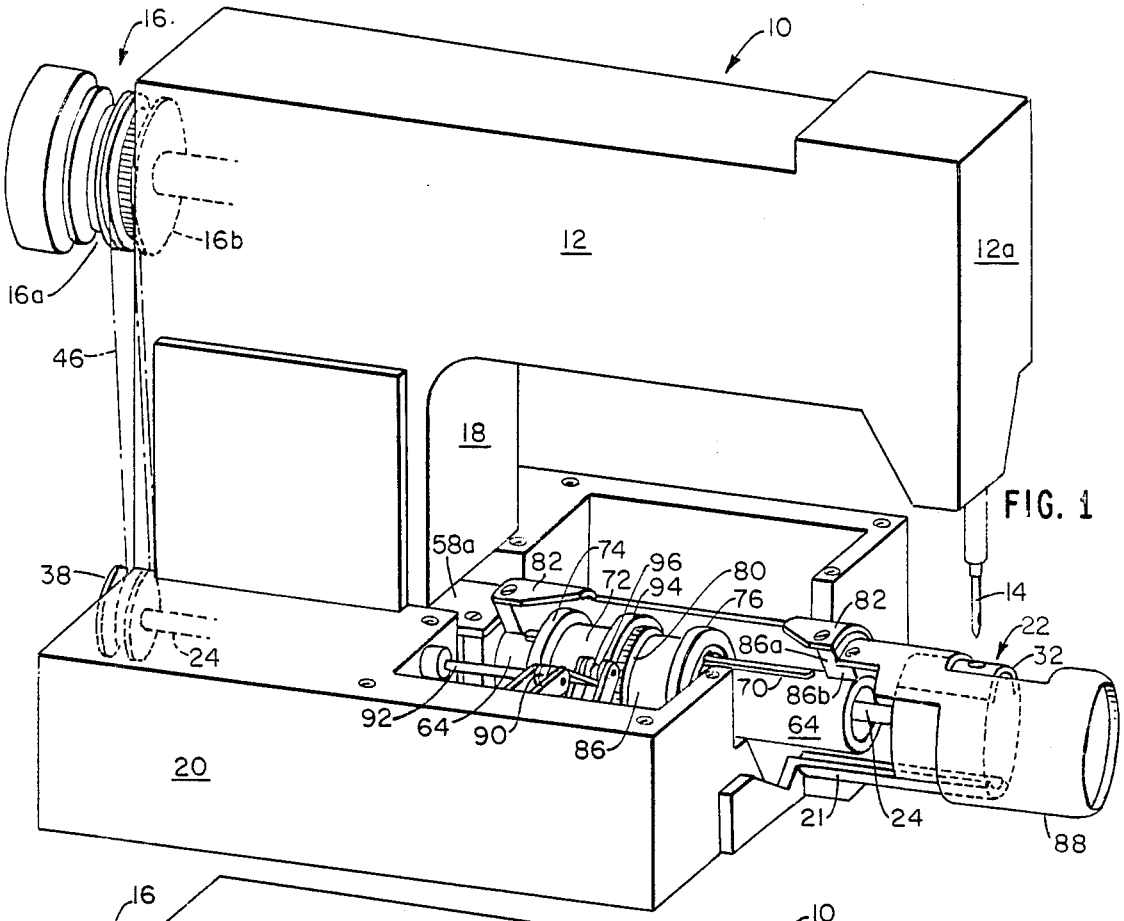
FIG. 1 is a perspective view of the articulated tube carriage of the invention at the innermost axial position with the bottom clamp tube and remaining components of the clamp assembly removed.

For illustration, the invention will now be described in terms of an embodiment specifically adapted for sewing labels on the inside pockets of finished suit jackets, sport coats and the like. A Mitsubishi PLK-0604 programmable sewing machine is selected for conversion based upon a number of existing features. This industrial grade lock stitch machine comes with a feed table to which the work can be clamped for movement in a plane. The work table is carried by means of an X-Y ball carriage assembly which can be driven in the Y direction parallel to the axis of the lower needle drive shaft, i.e., parallel to the lower arm and in the X direction horizontal and perpendicular to the Y axis. The X and Y carriage components are driven by timing belts which in turn are driven by stepper motors actuated electronically in accordance with a stored stitch program. The stitch program is stored in an electronically programmable read only memory (EPROM) in a removable cartridge. New stitch programs are entered electronically in the EPROM. A variety of EPROM's can be used to adapt the machine to different stitching tasks.

The Mitsubishi machine is modified in accordance with the invention by replacing the planar X-Y carriage assembly with an articulated tube carriage mounted around the hook shaft and by attaching a special clamp assembly to the tube carriage. In addition, the hook shaft is changed from oscillating motion to continuous rotation, and the throat plate and lower arm end are made cylindrical. The result is a machine in which the same programmable stitch system can now be used to perform any desired stitching operation on a cylindrical surface. Moreover, the dimensions of the end of the arm which carries the lower hook and bobbin assembly are small enough that an inside pocket of a sport coat, for example, can be slipped over the end and clamped in place for sewing a label completely automatically in a few seconds time. Moreover, by programming the stitch as an open zig-zag stitch over the edge of the label, if desired, the label will retain a hand-sewn appearance.

FIGS. 1–4 show the converted machine with the articulated tube carriage for translational and rotational motion. For clarity, the special clamp assembly is shown separately in FIGS. 13 and 14. The basic Mitsubishi machine 10 displays the conventional U-shaped sewing machine configuration comprising an upper horizontal arm 12 and stitching head 12*a* carrying at least one reciprocating upper needle 14. A hand wheel 16 connected to the upper needle drive shaft extends from the other end of the upper arm 12. Hand wheel 16 is equipped with a coaxial drive pulley 16*a* which is belt-driven by an auxiliary electric motor (not shown). The upper arm 12 is supported on upright portion 18 on top of a generally rectangular base 20. A relatively short arm 22 extends horizontally from the base 20 parallel to the upper arm and terminates in a nose-like cylindrical housing 22. The housing 22 includes a bobbin and a rotating or oscillating hook, driven via a hook shaft 24 which extends parallel to the upper arm. The hook shaft 24 is journalled in bearings 26 and 28 mounted as shown through an opening at the back of the base 20 and, on the other end, in the housing 22. The hook shaft 24 rotates a hook shown in phantom at 30 in FIG. 3 which carries a second thread supplied by the bobbin (not shown) which engages the thread loop produced by the penetrating upper needle 14 to form a lock stitch in the conventional manner. The upper needle 14 whose path is shown diagrammatically in FIG. 3 extends through an opening in a cylindrical throat plate 32 covering the top of the housing 22.

Figure 3:
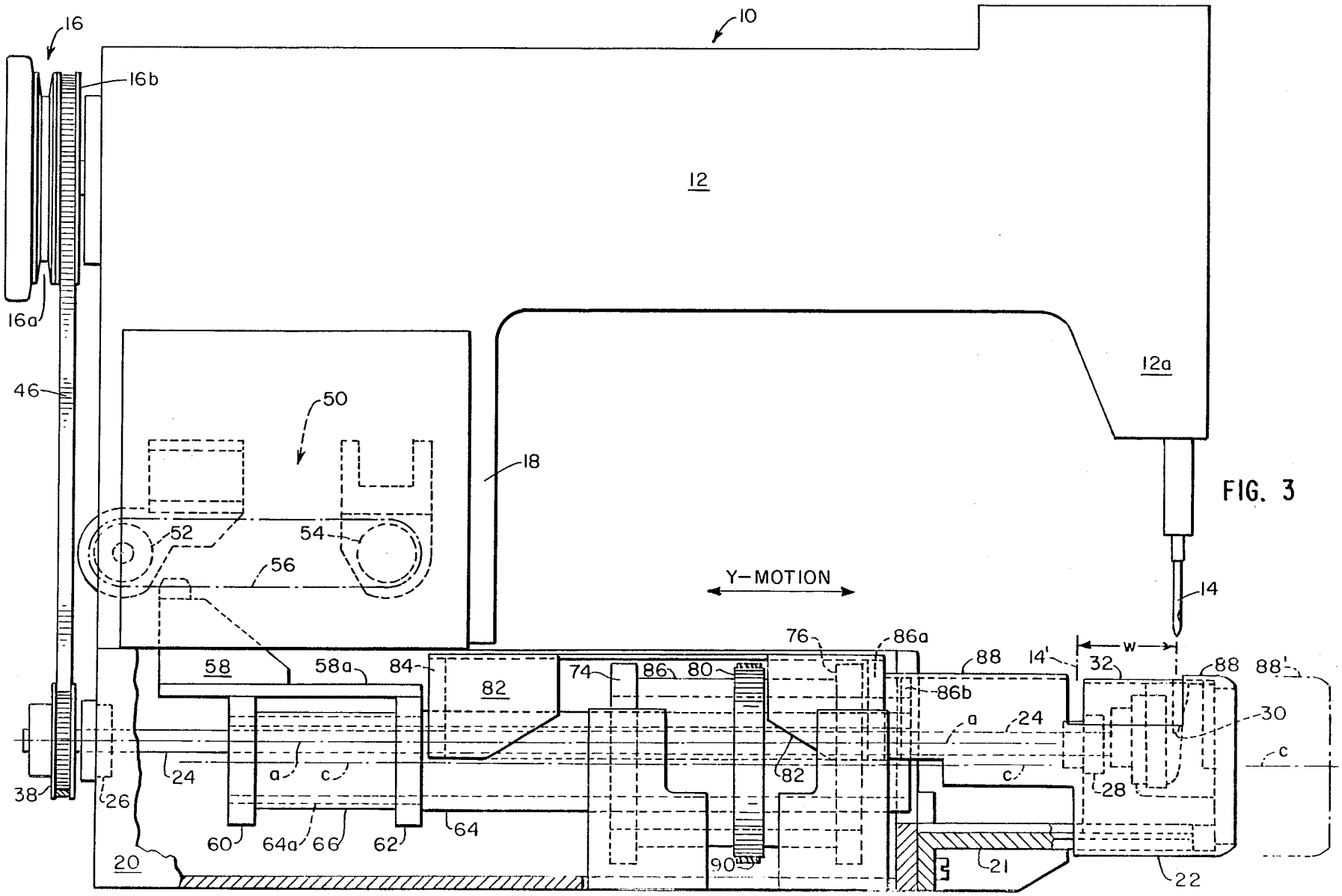
FIG. 3 is a side view of the sewing machine of FIG. 1 with the bottom clamp tube replaced, with other portions of the tube carriage in phantom.
Figure 4:
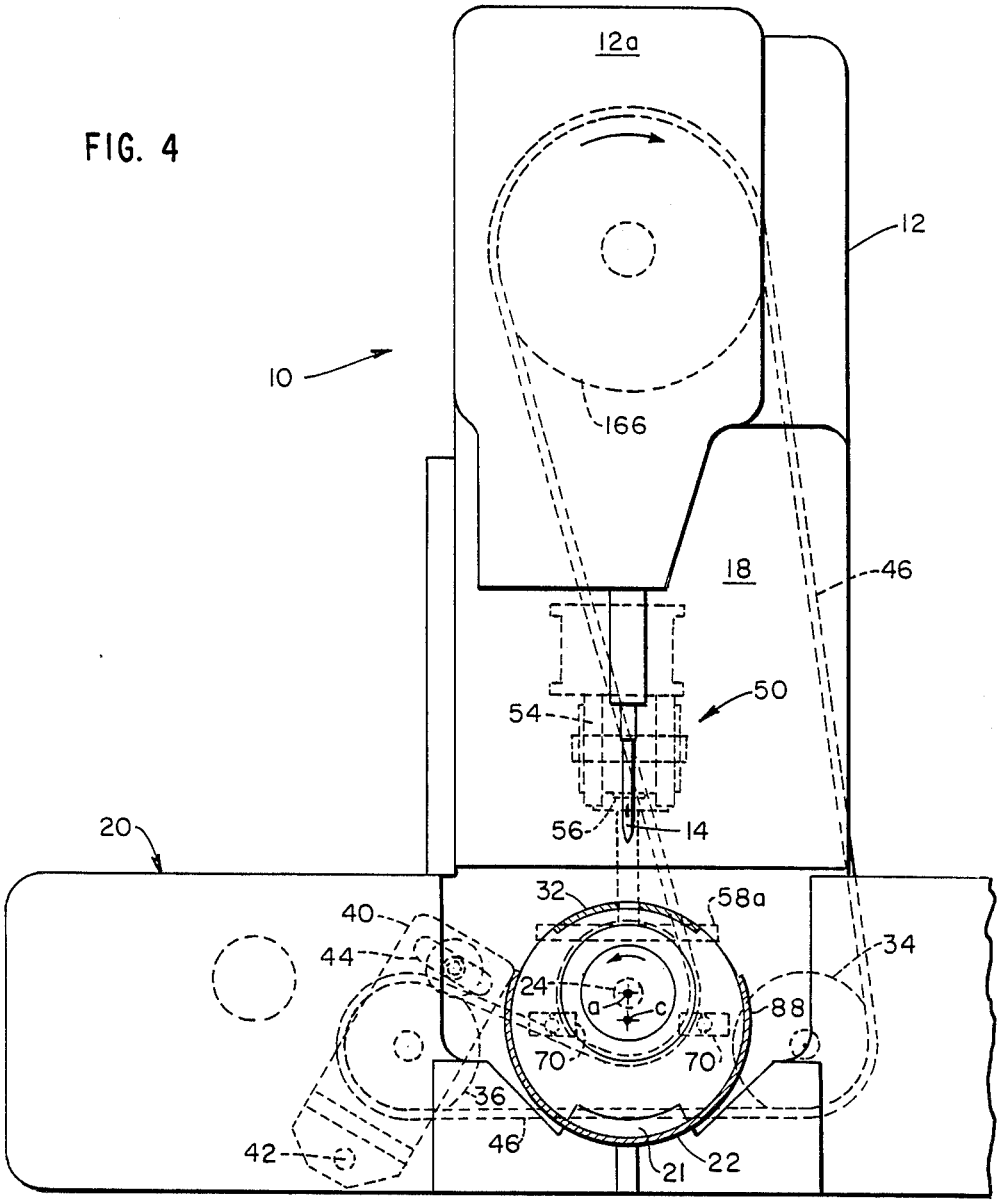
FIG. 4 is a front view of the sewing machine of FIG. 1 illustrating, inter alia, the pulley drive for the hook shaft.

In the unmodified machine, the hook shaft 24 is driven by linkages in the upright portion 18 and base portion 20 which cause the hook shaft to oscillate back and forth. In the present embodiment, it is desired to have the hook shaft 24 rotate continuously in a direction opposite to that of the needle drive shaft which carries the hand wheel 16. A reverse belt drive is implemented as shown in FIGS. 3 and 4 to impart counter-rotation to the hook shaft 24. A timing belt pulley is mounted at 16*b* on the hand wheel assembly. At the back of the base, two idler pulleys 34 and 36 (FIG. 3) are mounted substantially coplanarly with the pulley 38 on the end of the hook shaft 24. Idler pulley 36 is mounted conventionally on bracket 40 pivotally mounted to the base at 42 and adjustable by means of a bolt threaded into the base through slot 44. The timing belt 46 for the hook shaft goes down from the hand wheel timing belt pulley 16*b* around the outside of idler pulley 34 and then runs approximately horizontally over to the adjustable idler pulley 36 and after almost circumnavigating the pulley 36, the outside of the belt 46 passes around the hook shaft pulley 38 and back up to the hand wheel pulley 16*b*.

The elements described thus far in the detailed description deal only with the stitch forming mechanism and not the work feeding mechanism. The work feeding operation is controlled and powered separately.

The Mitsubishi PLK-0604 comes with a pair of independent stepper motors which control X and Y translation of the work table in the original machine.

Figure 6A:
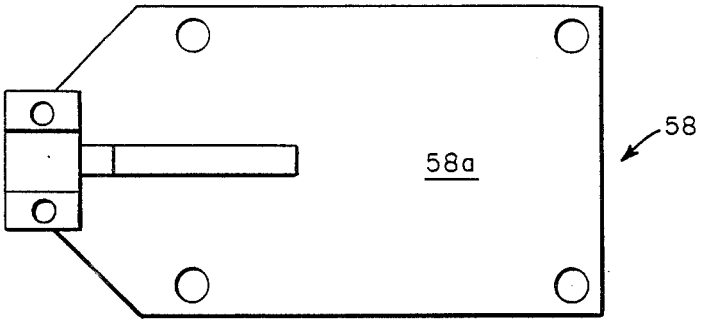
FIGS. 6A, 6B and 6C are respectively top, side and front views of the Y-motion bracket of FIG. 3.
Figure 6B:
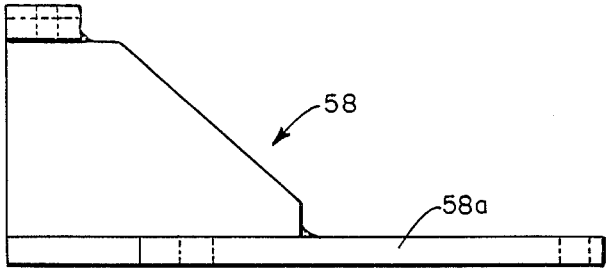
Figure 6C:
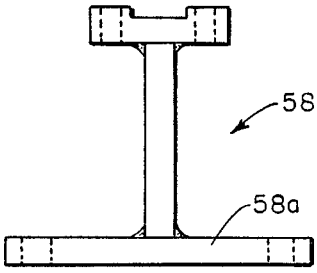
Figure 7A:
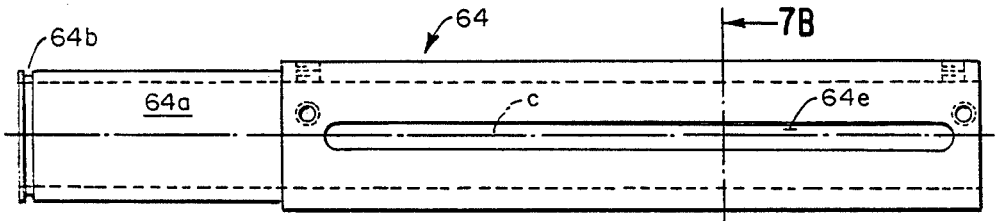
FIGS. 7A and 7B are respectively side and cross-sectional views of the Y-motion torque tube of FIGS. 1 and 3.
Figure 7B:
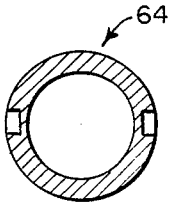

As shown in FIGS. 3 and 4, the Y-drive mechanism 50 (the Y direction being parallel to the axis a of the hook shaft 24) comprises a pair of pulleys 52 and 54 mounted on brackets as shown and carrying a timing belt loop 56. The bottom surface of the timing belt 56 is clamped to a Y-motion bracket 58 shown in more detail in FIGS. 6A–C. Flat lower plate or shoe 58*a* of the Y-motion bracket is rigidly attached to a pair of depending ring-shaped, Y-motion brackets 60 and 62 which serve as bearing caps. Inside the brackets 60 and 62 are annular bearings through which the reduced diameter end 64*a* of the Y-motion torque tube 64 is journalled. Bearing bracket 62 abuts the shoulder 64*c* (FIG. 7A) between the different diameter portions of the torque shaft 64. The left-hand end of the reduced diameter portion 64*a* of the Y-motion torque tube which extends through the bearing cap 60 has a groove 64*b* which receives a snap ring to secure the shaft axially to the Y-motion bracket 58. A cylindrical bearing spacer or bushing 66 occupies the space between the bearing brackets 60 and 62 and is slidably received over torque tube end 64*a*. The axis c of the torque tube is slightly lower than the axis a of the hook shaft 24 as shown in FIG. 3.

Figure 8A:
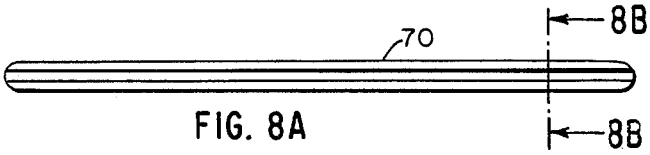
FIGS. 8A and 8B are respectively plan and sectional views of the Y-motion ball guide of FIGS. 1, 3 and 4.
Figure 8B:
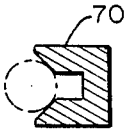

The function of the bearing brackets 60 and 62 is to drive the Y torque tube 64 in either axial direction. Note that torque tube 64 is tubular and hollow over its entire length so that the hook shaft 24 can extend through the torque tube to the bobbin housing 22. The elongated end 64*d* of the Y torque tube extends over the hook shaft 24 toward the end 22 of the lower arm. The outside of portion 64*d* of the torque tube (FIG. 7A) has a pair of opposed rectangular recesses 64*e* defined axially along each side. These recesses each receive a Y-motion ball guide or track 70 as shown in FIGS. 8A and 8B.

Figure 9A:
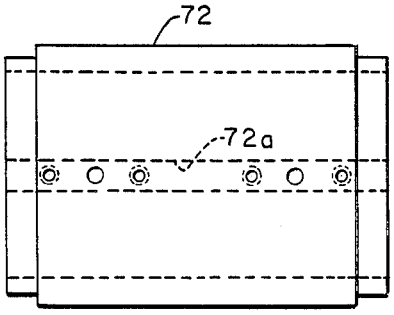
FIGS. 9A and 9B are respectively side and end views of the X motion torque tube of FIGS. 1, 3 and 5.
Figure 9B:
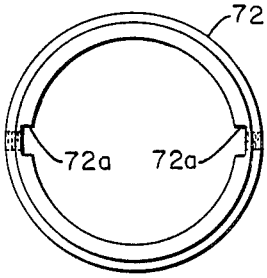

An X-motion torque tube 72 (FIG. 9A, 9B) of larger diameter than the Y-motion torque tube 64 is received coaxially over the portion 64*d* of the Y torque tube. As shown in FIGS. 9A and 9B, the X-motion torque tube has opposed recesses 72*a* formed axially on the inside wall. These recesses 72*a* receive ball guides similar to ball guides 70 on Y-torque tube 64. The ball guides in the recesses 72*a* extend along the length of the X-motion torque tube 72 and mate with the outside ball guides on the inner Y torque tube 64 in a telescoping manner to form the ball carriage. The ends of reduced diameter of the X-motion torque tube as shown in FIG. 9A are journalled in annular bearings housed by ring-shaped X-motion bearing caps 74 and 76 bolted to bearing cap mounting plate 78 on the floor of the base portion 20 of the sewing machine. These end bearings thus fix the axial location of the X-motion torque tube 72 with respect to the base 20 and support both the X-motion torque tube and in turn the axially slidable Y-motion torque tube 64 from the floor of the base 20. Affixed to the outside of the X-motion torque tube 72 is a driven pulley 80.

Figure 10B:
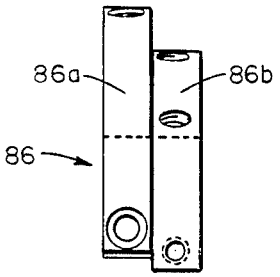
FIGS. 10A and 10B are respectively plan and side views of the right-hand clamp support bracket between the torque tube and the outer body tube of FIGS. 1 and 3.
Figure 10A:
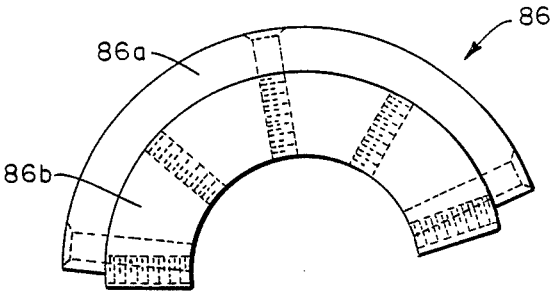
Figure 11A:
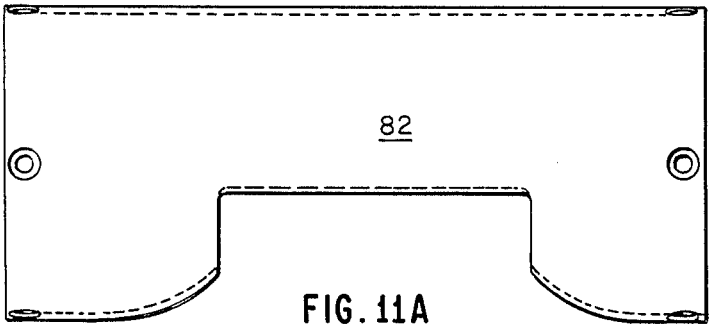
FIGS. 11A and 11B are respectively side and end views of the outer clamp body tube of FIGS. 1–4.
Figure 11B:
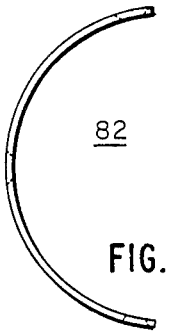
Figure 12B:
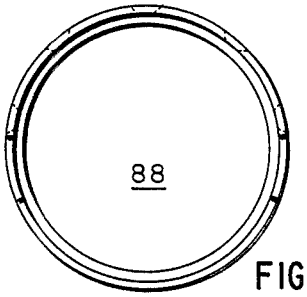
FIGS. 12A and 12B are respectively plan and end views of the bottom clamp tube of FIG. 3.
Figure 12A:
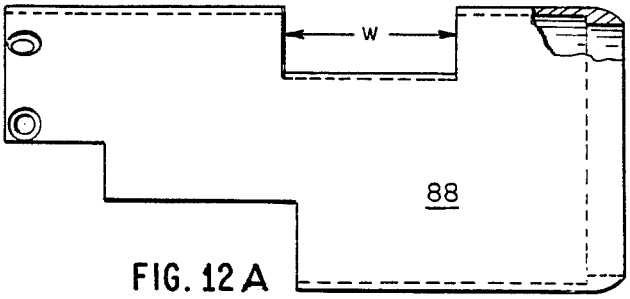

An outer clamp body tube (FIGS. 3, 11A and 11B) in the form of an elongated cylindrical shell with cut-away portions for clearance is mounted on the Y-motion torque tube by means of rear support bracket 84 and front clamp support bracket 86 (FIG. 10A). Brackets 84 and 86 space the main body tube 82 coaxially with the Y-torque tube so that it covers the bearing caps 74 and 76 as well as the driven pulley 80. The front support bracket 86, as shown in FIG. 10A, is composed of two annular sectors. The part which supports the outer main body tube 82 is the larger sector 86*a*. Bracket 84 is essentially identical to portion 86*a* of bracket 86. The portion 86*b* of reduced radius supports a cantilevered bottom clamp tube 88 with portions cut away for clearance as shown in FIG. 12A. The right-hand end of bottom clamp tube 88, as viewed in FIG. 12A and FIG. 3, fits coaxially over the end housing 22 and is rotatable thereon. By design, the axis of rotation of the entire tube carriage assembly coincides with the axis of the cylindrical housing 22.

Figure 2:
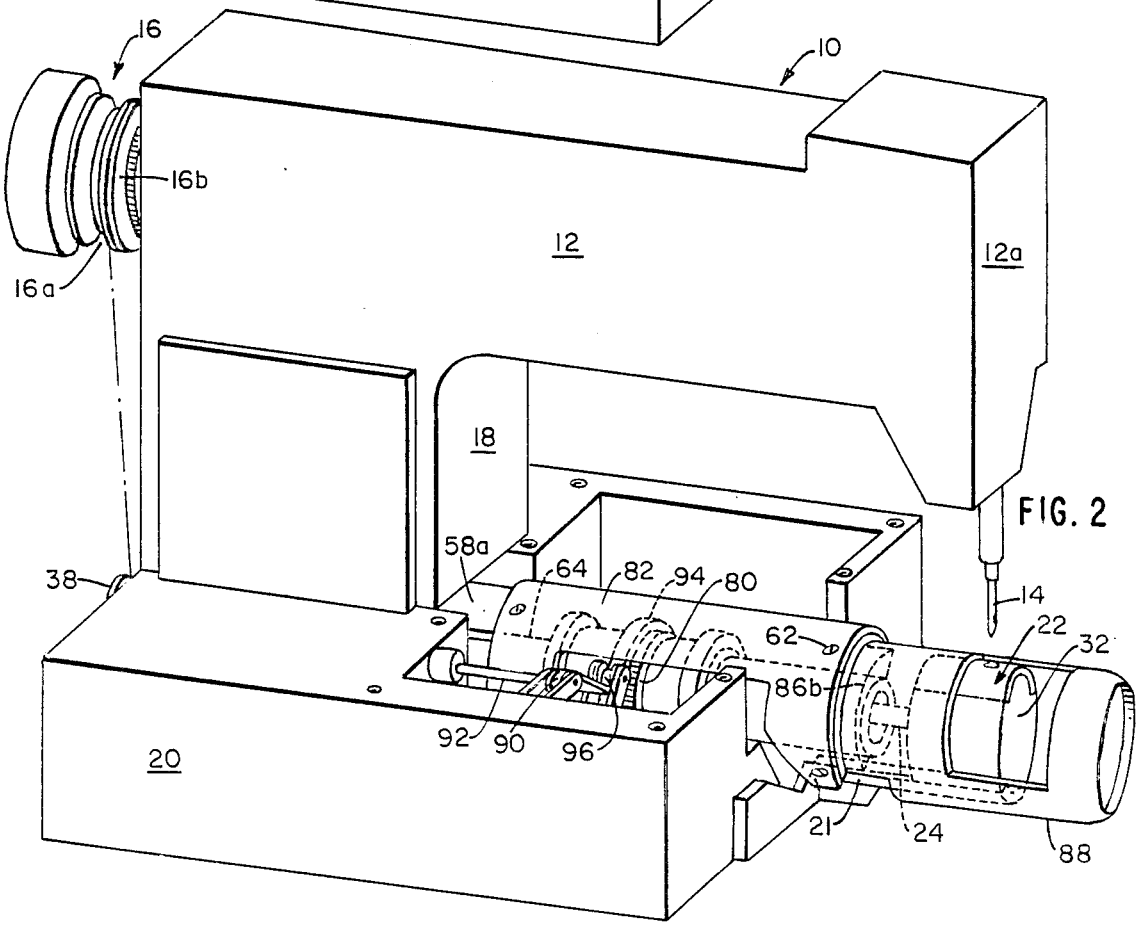
FIG. 2 is a similar perspective view of the articulated tube carriage of FIG. 1 rotated approximately 180° and protracted to the outermost axial position.
Figure 5:
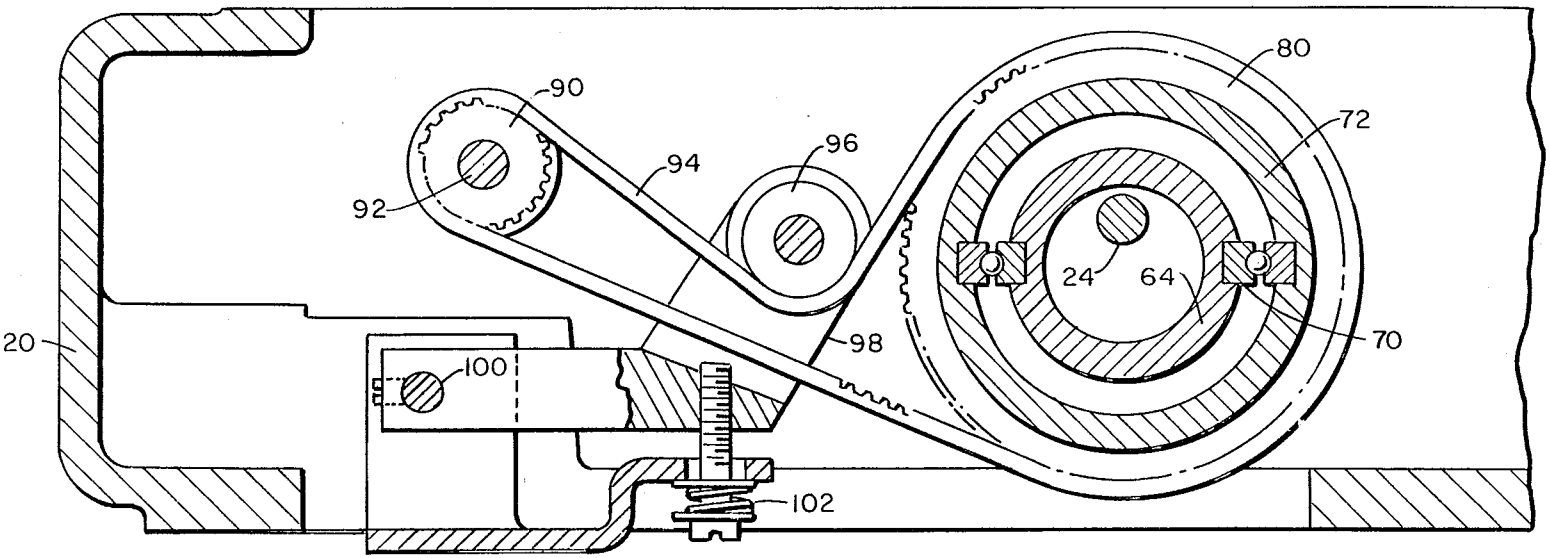
FIG. 5 is a front view of the base of the sewing machine of FIG. 1 showing the X-motion drive pulleys in detail.

The X-motion drive mechanism for rotating the tube assembly of FIG. 3 is shown in detail in FIGS. 1, 2 and 5. An X-motion drive pulley 90 is carried on the end of the X-motion stepper motor drive shaft 92. Drive pulley 90 carries a timing belt 94 which goes around driven pulley 80 affixed to the rotatable X-torque tube 72. A spring-loaded tensioning idler pulley 96 is rotatably mounted on the end of bracket 98 which is pivoted at 100 on a mounting block affixed to the floor of the base 20, as shown in FIG. 5. Tension spring 102 between bracket 98 and the floor urges the bracket 98 downward to keep the timing belt 94 taut. Thus, when the X-stepper motor (FIG. 4) is actuated, the X-torque tube 72 rotates carrying with it the Y-torque tube which is rotationally fixed to but axially slidable within the X tube, along with the outer clamp tube body 82 and the bottom clamp tube 88. However, unlike the X-torque tube 72, clamp tubes 82 and 88 also travel in the Y direction with the Y-torque tube when the Y stepper motor is actuated.

The notch or window w in the upper front portion of bottom clamp tube 88 in FIG. 3 and FIG. 12A represents the nominal axial length of the stitching area. The dimensions of the window w preferably correspond to the label size. The Y-tube may move the bottom clamp 88 out to 88', a distance approximately equal to the length of the window w, and still keep the penetrating upper needle 14 within the window w as indicated by dashed line 14'.

Figure 13:
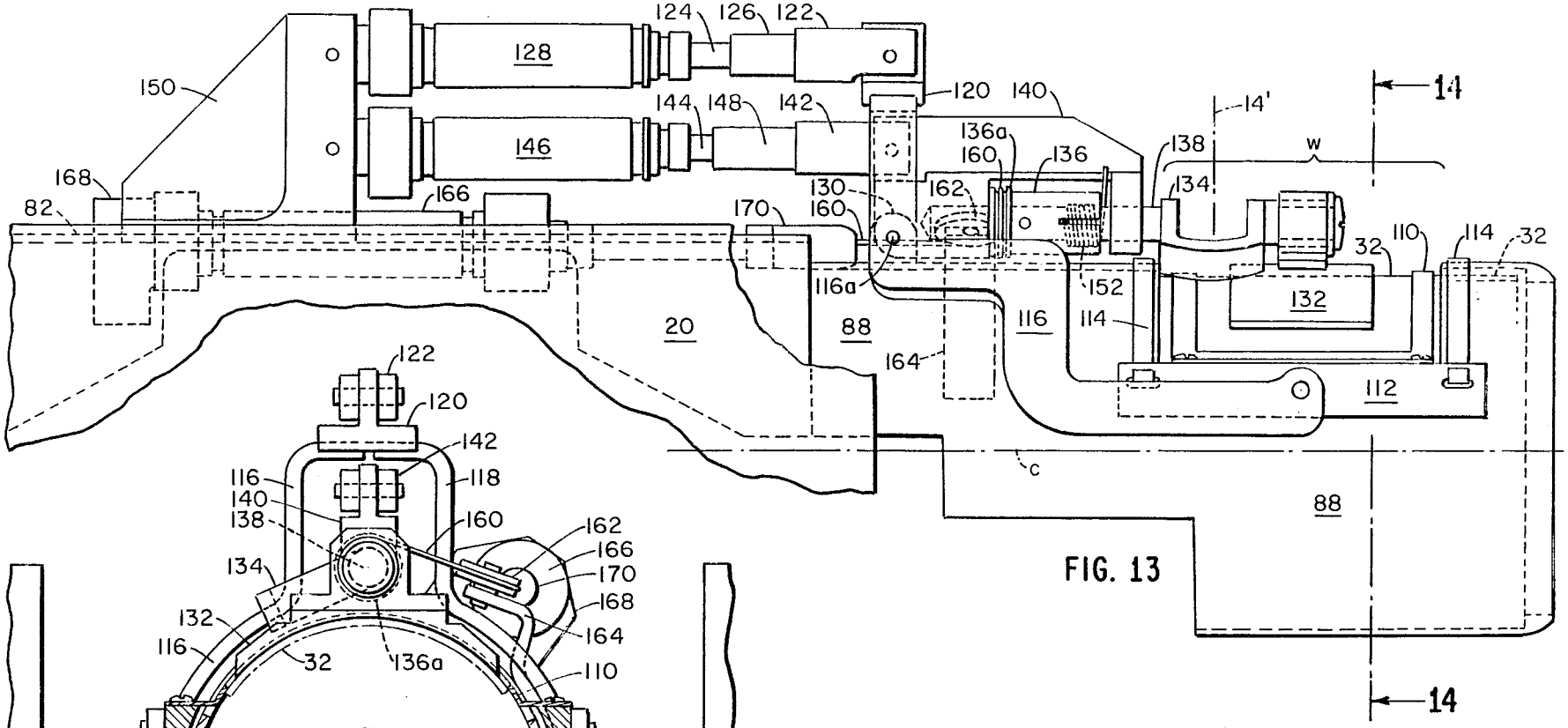
FIG. 13 is a side view of the clamp assembly according to the invention.
Figure 14:
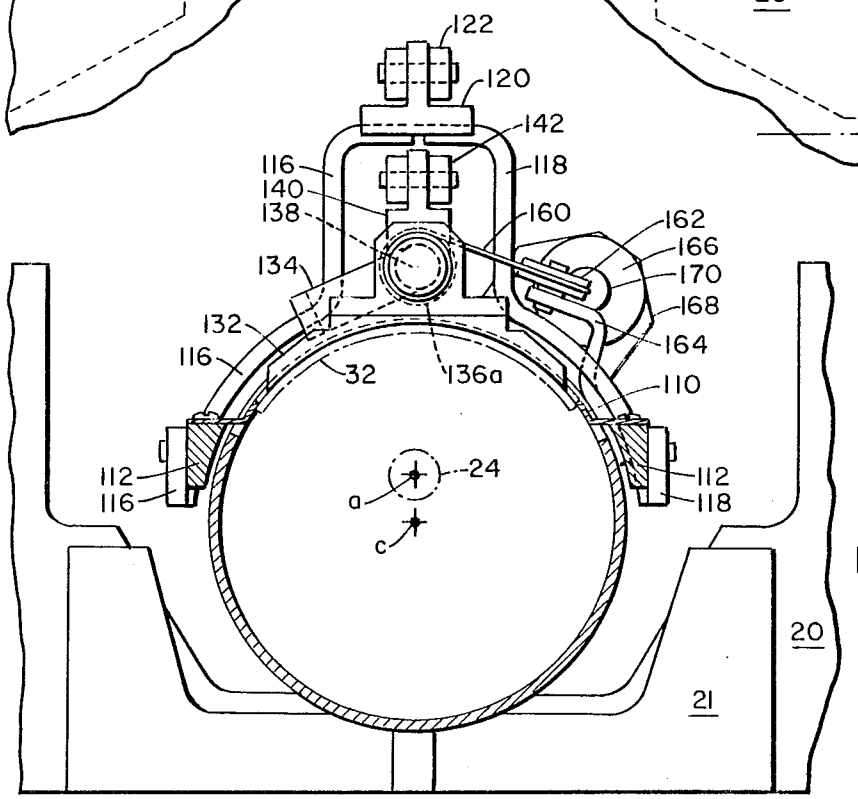
FIG. 14 is a front view of the clamp assembly of FIG. 13 with the swivel block and lower cylinder removed.

A special cylinder-actuated clamp assembly clamps the pocket of the garment firmly to the lower clamp tube 88 over window w by means of a pivoting two-part clamp. The label locating clamp 110 is in the form of a thin arcuate rectangular metal frame which sits just inside the window w to press the work against the throat plate as shown in FIGS. 13, 18A and 18B. The clamp 110 is bolted to two side bars 112 which lie against the outer surface of the lower clamp tube 88 substantially parallel to the c axis. Side bars 112 are also connected by optional arcuate metal straps 114 which extend along the edge of the window w over the lower clamp tube 88. The inside of frame 110 may be cut away or relieved so as to only contact the label at a few points, e.g., two at each corner, so that a zig-zag stitch may be made over the edge of the label.

Figure 15A:
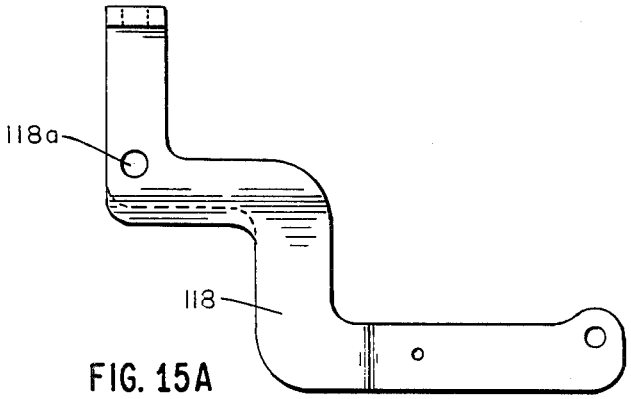
FIGS. 15A and 15B are respectively side and front views of the left-hand clamp arm of FIG. 14.
Figure 15B:
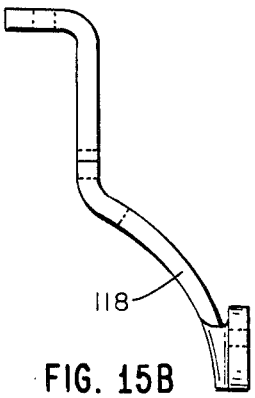

The midpoint of each side bar 112 is pivotally connected to the front end of the respective arm 116, 118. The left-hand arm 118 is shown in detail in FIGS. 15A and 15B. The right-hand arm is identical but reversed. The arms 116 and 118 are bolted to the bottom of an upside down T-shaped connecting bracket 120 pivotally connected to a clevis 122 (FIG. 13) which is attached to cylinder plunger 124 with a cylinder stop 126 in between. Plunger 124 is actuated by means of a single acting spring return pneumatic cylinder 128.

Arms 116 and 118 have aligned through holes 116*a* and 118*a* which receive an axle pin. The pin passes through a pivot block 130 (FIGS. 13, 16A, 16B) which is braised to the surface of the lower clamp tube 88. Thus, arms 116 and 118 are pivotally connected to a fixed point on the rear surface of the lower clamp tube 88.

The garment itself is firmly held by the label locator frame 110 carried on the end of the arms 116 and 118; however, it is also desirable to clamp the central portion of the label inside the stitching pattern. For this purpose, an arcuate shoe 132 (FIGS. 13, 19A, 19B) is pivotally mounted on the end of U-shaped link or yoke shaft 134. The yoke shaft 134 is rigidly connected to capstan 136 by means of an axle 138 which is journalled in swivel block 140 (FIGS. 17A, 17B). Swivel block 140 has a lower through hole 140*a* which receives the same axle or pin which extends through the arms 116 and 118 so that the swivel block 140 is also pivoted at the same point to the clamp tube 88. In addition, the upper rear corner of the swivel block 140 is pivotally connected to clevis 142 connected to the plunger 144 of a second pneumatic cylinder 146. A cylinder stop 148 is inserted between the clevis 142 and the cylinder 146 limiting the travel of the plunger 144.

Swivel block 140 carrying the shoe 132, and arms 116 and 118 carrying the label clamp 110 are both pivotally mounted to the clamp tube 88, but are separately actuated by cylinders 146 and 128, respectively, via pneumatic lines energized by a foot treadle (not shown). The rear ends of these cylinders are pivotally connected to a cylinder pivot block 150 which is brazed or otherwise secured to the surface of the outer clamp tube body 82.

Capstan 136 has a hollow front end which receives a torsion spring 152, one end of which is secured in a slot as shown. The torsion spring serves to spring bias the yoke 134 to the position shown in FIG. 13. The yoke 134 may be rotated or flipped about the axis of the axle 138 to the other side out of the stitch path to allow stitching to be completed. The capstan 136 is rotated with a cable 160 (FIG. 14) which goes around the pulley-like end 136*a* of the capstan. The cable 160 goes around an idler pulley 162 mounted to the bottom clamp tube 88 on bracket 164 to a third pneumatic cylinder 166 mounted to one side of the main outer clamp body 82 on block 168. The end of the cable 160 is connected to the cylinder plunger by cable anchor block 170 (FIG. 13). Actuating the third cylinder 166 causes the plunger to be retracted pulling the cable 160 and rotating the capstan 136 so that the U-shaped yoke 134 flips over to the other side. Cylinder 166 is a double-acting cylinder powered only on one end so that the return spring action, which has the effect of pulling the plunger out, is carried out by the torsion spring 152 inside the capstan 136 to return the yoke 134 to the position shown in FIG. 13.

In operation, cylinders 128 and 146 are actuated to retract their respective plungers in order to pivot the shoe 132 and clamp 110 upwards by as little as a half an inch to allow the work to be slipped over the end of the lower arm, i.e., over the right-hand end of the lower clamp tube 88 as shown in FIG. 3. For a suit jacket, the inside pocket of the coat would be slipped over the end of tube 88 over the window w. Next, the label, if not tacked on beforehand, would be located properly on the pocket inside the window area. When the work is ready, cylinders 128 and 146 are deactuated and the spring return of the cylinders pivots the clamps into position firmly grasping the garment pocket and the label. The stitching begins at a preselected point or "origin" along the periphery of the label. For example, the stitching may begin at a point inside the U-shaped yoke 134 as shown by needle position 14' in FIG. 13. From this position, the work is fed so that the stitching proceeds around the periphery of the label. At a preselected point, in the programmed stitching pattern, for example, at the third corner, the third cylinder 166 is energized to flip the yoke 134. Stitching meanwhile proceeds around the label and crosses the point where it began so as to slightly overlap the stitching, thus completing the 360° stitching pattern. When the stitching is completed, the stitching needles stop, but the stepper motors continue to feed so that the carriage is returned to the origin for the next sewing operation. When the work reaches the origin the cylinders 128 and 146 are simultaneously actuated to raise the clamps to allow the finished garment to be removed.

The embodiment of the foregoing description increases the speed of stitching labels on inside coat pockets while retaining a hand sewn look. Using the same X and Y stepper motors as in the original planar table feed machine permits the use of the same programmable cartridge system to design stitch patterns for a variety of labels, patches, emblems or embroidery without modifying the basic operation of the standard machine. The axis of the articulated tube carriage assembly is offset from the axis of the hook shaft, but by design coincides with the axis of the end of the lower arm which houses the bobbin and hook mechanism. In addition, the spring-loaded, dual clamp system travels with the outer tube body of the rotatable telescoping carriage. Thus, all components of the clamp mechanism other than the clamps themselves are behind the stitching area so that the stitching area is as unobstructed as possible. The unique yoke flipping operation in conjunction with the constant label clamp permits uninterrupted 360° sewing with no change in pressure on the label or the garment. Automatic label sewing enables a significant decrease in the labor formerly associated with pocket labels.

The foregoing description and drawing of a preferred embodiment are intended only to illustrate a specific implementation. Many variations, modifications, additions and improvements for these or other specific applications will occur to those skilled in the art without departing from the scope of the invention as indicated by the appended claims.

What is claimed is:

1. An automatic sewing machine, comprising parallel upper and lower arms with cooperating upper and lower stitch forming mechanisms including at least one work penetrating reciprocating needle carried by the upper arm, said lower arm terminating in an end having an upper cylindrical surface with a needle hole for receiving said reciprocating needle, the remainder of said lower arm end being of radial extent less than or equal to that of said cylindrical surface, a cylindrical work carrying sleeve slidably received over the end of said lower arm coaxial with said cylindrical surface thereof, said sleeve having a sewing window formed therein encompassing said needle hole, X-Y drive means for imparting to said sleeve translational motion along the axis thereof and rotational motion about the axis thereof in accordance with electronic commands, and clamp means connected for rotation and translation with said sleeve for releasably clamping the work to said window, whereby the work can be stitched inside the window as desired by controlling said X-Y drive means with a predetermined stitch program.

2. The sewing machine as defined in claim 1, wherein said drive means includes a Y-torque tube, Y-stepping motor means, belt means for converting the rotary motion of said Y-stepping motor means to linear motion, link means for connecting said Y-torque tube to said belt means for imparting translational motion to said Y-torque tube along the axis thereof, an X-torque tube, ball carriage means for axially slidably mounting said X-torque tube coaxially over said Y-torque tube for rotation therewith, X-stepping motor means, and pulley means for rotating said X-torque tube proportionately to the rotary motion of said X-stepping motor means, said work carrying sleeve extending coaxially from the front end of said Y-torque tube.

3. The sewing machine as defined in claim 1, wherein said X-Y drive means includes an articulated, rotatable, telescoping multi-tube carriage assembly coaxially aligned with said sleeve means and extending in a direction away from said lower arm end.

4. A sewing machine as defined in claim 3, further comprising a drive shaft in said lower arm extending parallel thereto out to said lower arm end to drive said lower stitch forming mechanism, said drive shaft extending in parallel through said multi-tube carriage assembly.

5. A sewing machine as defined in claim 4, wherein said drive shaft axis is not aligned with the axis of said multi-tube carriage assembly.

6. A sewing machine as defined in claim 2, further comprising a drive shaft in said lower arm extending parallel thereto out to the end of said arm to drive said lower stitch forming mechanism, said shaft extending in parallel through said Y-torque tube.

7. A sewing machine as defined in claim 6, wnerein said drive shaft axis is not aligned with the axis of said Y-torque tube.

8. A sewing machine as defined in claim 1, wherein said clamp means includes an arcuate rectangular frame slightly smaller than said window having a cylindrical radius approximately matching that of said cylindrical surface of said lower arm end, and bracket means for pivotally connecting said frame to said sleeve so as to pivot away from said sleeve.

9. A sewing machine as defined in claim 8, further comprising a shoe having an arcuate surface for applying pressure to the work at the center of said window in a direction toward the axis of said sleeve, bracket means for pivotally connecting said shoe to said sleeve so as to pivot away from said sleeve.

10. A sewing machine as defined in claim 9, wherein said clamp means further includes cylinder means for pivoting said shoe and frame away from said sleeve off of the work surface in order to allow the insertion or removal of work on command, and spring biasing means for normally urging said shoe and frame against the work.

11. A sewing machine as defined in claim 10, wherein both said bracket means for pivoting said shoe and said frame have a common pivoting axis.

12. A sewing machine as defined in claim 10, further comprising a rotatable link extending parallel to the axis of said sleeve and having a yoke shaped section located axially inside the stitching window forming an open area so that the reciprocating needle can cross the axis of said link, and means for rotating said link about its axis such that the yoke shaped section flips over to the other side to enable the needle to complete a 360° pattern.

13. A sewing machine as defined in claim 12, further comprising a swivel bracket pivotally mounted to said sleeve and having a pair of aligned axially spaced openings, a capstan connected to said link coaxially located in the space between said swivel bracket openings, said link extending through said openings for rotation therein, and means for imparting rotation to said capstan on command.

14. A sewing machine as defined in claim 13, wherein said capstan rotation imparting means includes a linearly actuating cylinder rigidly mounted to said X-Y drive means and cable means operatively connected between said capstan and said cylinder, whereby actuation of said cylinder rotates the capstan and the yoke shaped section of the link between the shoe and the swivel bracket to complete the 360° stitching pattern.

* * * * *